United States Patent [19]

Eck et al.

[11] Patent Number: 4,950,327

[45] Date of Patent: Aug. 21, 1990

[54] CREEP-RESISTANT ALLOY OF HIGH-MELTING METAL AND PROCESS FOR PRODUCING THE SAME

[75] Inventors: Ralf Eck; Gerhard Leichtfried, both of Reutte, Austria

[73] Assignee: Schwarzkopf Development Corporation, New York, N.Y.

[21] Appl. No.: 264,959

[22] PCT Filed: Jan. 26, 1988

[86] PCT No.: PCT/AT88/00002

§ 371 Date: Sep. 27, 1988

§ 102(e) Date: Sep. 27, 1988

[87] PCT Pub. No.: WO88/05830

PCT Pub. Date: Aug. 11, 1988

[51] Int. Cl.[5] ..... C22C 29/12

[52] U.S. Cl. ..... 75/232; 75/244; 75/245; 419/12; 419/13; 419/19; 419/23; 419/28; 419/29; 419/33; 419/32; 419/66

[58] Field of Search ..... 419/12, 13, 19, 20, 419/23, 29, 38; 75/232, 246

[56] References Cited

U.S. PATENT DOCUMENTS

| | | | |
|---|---|---|---|
| 3,954,421 | 5/1976 | Heuschkel | 29/183 |
| 3,982,970 | 9/1976 | Webster et al. | 148/20.3 |
| 4,588,552 | 5/1986 | Schöder et al. | 419/19 |
| 4,599,214 | 6/1986 | Luton | 419/4 |

FOREIGN PATENT DOCUMENTS

| | | |
|---|---|---|
| 3441851 | 1/1987 | Fed. Rep. of Germany . |
| 1064056 | 4/1967 | United Kingdom . |
| 1129462 | 10/1968 | United Kingdom . |
| 1298944 | 12/1972 | United Kingdom . |
| 0119438 | 9/1984 | United Kingdom . |

OTHER PUBLICATIONS

Powder Metallurgy, Sintered and Composite Materials—1st Edition, VEB Deutscher Verlag Fuer Grundstoffindustrie, Leipzig, East Germany, pp. 400–425, by W. Schatt.

*Primary Examiner*—Stephen J. Lechert, Jr.
*Assistant Examiner*—N. Bhat
*Attorney, Agent, or Firm*—Morgan & Finnegan

[57] ABSTRACT

A creep-resistant alloy having a tiered structural arrangement of one or several refractory metals Mo, W, Nb, Ta, V, Cr containing certain doping agents, as well as a process for producing the same. The special doping agents are compounds and/or mixed phases of such compounds selected from the group of oxides, nitrides, carbides, borides, silicates or aluminates having a melting point higher than 1500° C. The size of their grains is $\leqq 1.5$ μm, their proportion in the alloy is comprised between 0.005 and 10% by weight. Unlike in the known state of the art, the use of porassium as doping agent is avoided in this alloy. A good reproducible consolidation and in particular high densities during sintering can thus be obtained. Furthermore, this alloy has better ambient temperature, heat and creep resistance properties than known alloys of refractory metal with a tiered structual arrangement.

7 Claims, No Drawings

CREEP-RESISTANT ALLOY OF HIGH-MELTING METAL AND PROCESS FOR PRODUCING THE SAME

The invention relates to a sintered alloy consisting of one or several of the high-melting metals Mo, W, Nb, Ta, v, and Cr with a tiered structural arrangement, such alloy having excellent thermal resistance combined with outstanding resistance to creep at high temperatures, as well as to a process for the manufacture of such alloy.

High-melting metals, because of their high melting point and high resistance to heat, are frequently used for molded parts that are expected to withstand high temperatures.

However, in many cases, high-melting metals in the pure form are not usuable for applications where good thermal resistance and high resistance to creep are important, i.e., where good mechanical strength is required at high temperatures over long periods of time.

In the past, two important different types of alloying of high-melting metals have been developed in order to increase the resistance to heat and creep of the high-melting metals at high temperatures.

With the one type of alloying of high-melting metals, certain elements are added to the basic material consisting of high-melting metal, said elements being present in the structure of the finished alloy in the form of finely dispersed particles. In this way, the thermal resistance and the resistance to creep at high temperatures are increased as compared to the high-melting metal in its pure form. It is of importance with such alloys that the enhanced properties are obtained without special mechanical reformation in the course of the manufacturing process.

The best-known representative of this type of alloy is the so-called TZM, which is a molybdenum alloy which typically contains about 0.5% by weight titanium, 0.08% by weight zirconium, and 0.05% by weight carbon.

A high-melting alloy of this type is described in US-PS 3,982,970. According to the latter, the basic material is solidified or strengthened by dispersion with the help of a thermal treatment in a special atmosphere. According to this patent, a suitable atmosphere is one containing particles of thorium oxide or aluminum oxide with a grain size of $<1$ μm.

Another alloy of this type consisting of high-melting metal based on molybdenum is described in German published patent disclosure DE-OS 34 41 851. This alloy contains 0.2 to 1% by weight oxides of the trivalent or quadrivalent metals as dispersed particles.

With all known alloys of high-melting metals that are produced without special mechanical reforming and in which dispersed particles effect increased heat and creep resistance at high temperatures as compared to the pure highmelting metal, the temperature up to which such resistances are sufficiently maintained is still inadequate for many application cases.

A second type of alloying of high-melting metals has been developed in order to significantly raise the application temperature of high-melting metals with sufficient heat and creep resistance properties. With this type of alloying of high-melting metals, which can be accomplished only in the powder-metallurgical way, the basic material of high-melting metal is doped with certain elements and, in the course of the manufacturing process, subjected to high mechanical reforming with a reforming degree of at least 85 percent. In this way, a highly defined structural arrangement of the alloy of highmelting metal is obtained, i.e., the so-called tiered structure that is characterized by grains shaped in the structure in an oblong form, with a ratio of length to width of the grains of at least 2 : 1.

Known alloys of high-melting metals of this type include, for example, tungsten and molybdenum alloys, which normally are doped with small amounts of aluminum and/or silicon and potassium. It is of importance with these alloys of high-melting metals that at least potassium has to be contained in the alloy so as to obtain the formation of a tiered wire structure. The additional doping elements such as aluminum and/or silicon effect that the potassium, in the course of the sintering step, does not completely diffuse from the material, whereas such additional doping elements themselves escape practically completely during the sintering process. The doping elements aluminum, silicon and potassium may be basically liquid or in the form of their solutions or added also in the dry state in the form of solid powder. However, both methods of adding said doping elements are not without problems in the large-scale production of said alloys made from high-melting metals. If the doping elements are added or introduced dry in the form of solid powder, the introduction of the potassium can be usefully accomplished only in the form of the potassium silicates. However, potassium silicates have the drawback that they are hygroscopic, which means it is very difficult to uniformly distribute them in the powder mixture. Adding or introducing the doping elements wet in the form of solutions is not without drawbacks in view of a reproducible production because the high volatility of the solutions, again particularly in the case of potassium, makes it difficult to obtain sintering with high sinter densities, which high density would be high beneficial to the subsequent mechanical reforming step. In the past, no great significance has been attributed to incorporating doping elements with a very specific grain size.

Said alloys produced from high-melting metals are known from W. SCHOTT: "Pulvermetallurgie, Sinter- und Verbundwerkstoffe", (Powder Metallurgy, Sintered and Composite Materials), lst Edition, VEB Deutscher Verlag fuer Grundstoffindustrie, Leipzig, East Germany, pp 400–425.

EU Application Al 119 438 describes another molybdenum alloy of this type, in which the molybdenum is doped with about 0.005 to 0.75% by weight of the elements aluminum and/or silicon and potassium. It is stated, furthermore, in this earlier publication that the high-temperature properties of the alloy can be enhanced even further by additionally doping this alloy with 0.3 to 3% by weight of at least one compound selected from the group of the oxides, carbides, borides and nitrides of the elements La, Ce, Dy, Y, Th, Ti, Zr, Nb, Ta, Hf, V, Cr, Mo, W, and Mg. However, nothing is mentioned in said earlier publication about any particularly beneficial grain size of the doping elements in the manufacture of this alloy.

The objective of the present invention is to create an alloy with a tiered structural arrangement from one or several high-melting metals, in which the use of potassium as doping element is avoided, so that a well-reproducible manufacture or production of the alloy and in particular high densities during sintering can be achieved. In addition, the alloy of the invention is expected to exhibit enhanced room temperature and heat and creep resistance properties as compared to the known alloys of high melting metals with a tiered structural arrangement.

According to the invention, this objective is accomplished in that the alloy comprises 0.005 to 10% by weight of one or several compounds and/or one or several mixed phases of the compounds selected from the group of oxides, nitrides, carbides, borides, silicates or aluminates with a grain size of ≦1.5 μm, whereby the additions are limited to compounds and/or mixed phases having a melting point above 15000° C.

Based on the known state of the art, the use of potassium as doping element was imperative in the manufacture of alloys of high-melting metals with a tiered structural arrangement, so that allowance had to be made for the serious problems with which the production was afflicted due to the utilization of potassium.

The present invention is based on the completely surprising realization that if defined compounds are used as doping materials for the manufacture of high-strength and creep-resistant, sintered alloys of high-melting metals with a tiered structural arrangement, the element potassium can be dispensed with.

An important precondition for the suitability of said doping materials is that they have to be incorporated in the alloy in the finest possible form. The formation of a satisfactory tiered structural arrangement is accomplished only by this additional measure.

The alloy of high-melting metal according to the invention exhibits heat and creep resistance values at high temperatures that surpass those of the known alloys of high-melting metals with a tiered structural arranqement. Even the strenqth values at room temperature are at least approximately comparable to those of the known alloys of high-melting metals depending on the amount of doping material added, but even may surpass the values of the known alloys to some extent.

A particularly advantageous alloy of high-melting metal with a tiered structural arrangement according to the invention contains from 1 to 5% by weight of the oxides and/or mixed oxides of one or several elements selected from the group La, Ce, Y, Th, Mg, Ca, Sr, Hf, Zr, Er, Ba, Pr, Cr, with a grain size of ≦0.5 μm in each case.

Another particularly beneficial alloy of high-melting metal with a tiered structural arrangement according to the invention contains from 1 to 5% by weight of at least one of the borides and/or nitrides of Hf, with a grain size of ≦0.5 μm in each case.

It has been found that the oxides La2O3, CeO2, Y2O3, ThO2, MgO, CaO; the mixed oxides Sr(Hf,Zr)O3, ZrO2, Er2O3, SrZrO3, Sr4Zr3O10, BaZrO3, as well as $La_{0.94}Sr_{0.16}CrO3$; and the borides HfB, HfB2 and HfN are particularly suitable doping materials if used within alloying proportions of from 1 to 5% by weight. With certain compounds and in particular with yttrium it is possible to significantly increase the tensile strength and creep resistance even with doping material additions in the amount of at least 1% by weight. Alloying proportions in excess of 5% by weight, however, do not substantially improve the afore-mentioned properties in most cases, so that in view of the fact that the doping materials are, as a rule, very expensive, the preferred range can be limited to 5% by weight at the most.

For producing the alloy according to the invention, molybdenum, tungsten and chromium as well as their alloys are particularly suitable as high-melting metals.

The alloy of high-melting metal according to the invention is exclusively producible by the powder-metallurgical method.

The alloy of high-melting metal according to the invention is produced in a particularly advantageous way by adding to the powdery high-melting metal or metals 0.005 to 10% by weight of one or several compounds and/or one or several mixed phases of the compounds selected from the group of the hydroxides, oxides, nitrides, carbides, borides, silicates or aluminates, such compounds being used in the form of powder with a grain size of ≦1.5 μm and having a melting point in excess of 1500° C.; compressing and sintering the powder mixture in the known way; and subjecting the resulting sintered body to mechanical reforming with a degree of reformation of at least 85% and to the required heat treatments; and finally subjecting it to recrystallization annealing.

The great advantage lies in the fact that the doping materials according to the invention can be incorporated in the high-melting metal powder in the dry state in the form of solid powders. Of importance is only that the doping materials are introduced with a high degree of fineness in the form of a discrete, i.e., non-agglomerated and non-aggregated powder with the afore-specified grain size. Such a powder can be obtained, for example by spray-drying compounds that precipitate in the finest possible form. The distribution of such a powder, which should be as uniform as possible, is accomplished by forced mixing.

Another method of accomplishing the required fine granular structure or form of the doping materials in the finished alloy is to introduce such materials in the form of compounds that are decomposable at low temperatures, for example in the case of lanthanum as lanthanum hydroxide La(OH)3; lanthanum carbonate La2(CO3)3.8H2O; lanthanum heptahydrate LaCl3.7H2O; or lanthanum molybdate La2(MoO4)3. By grinding these compounds-which can be readily ground - into the high-melting metal starting powder, the compounds are crushed further and will disintegrate during sintering even at low temperatures, so that they are subsequently present in the completely sintered alloy of high-melting metal in the form of lanthanum oxide with the desired fine granular structure.

Introduction with the required fine granularity can be accomplished also by vaporizing the high-melting metal starting powder with the doing materials according to the invention, for example by the sputtering method.

If the doping materials have melting points far above 1500 ° C., the quantity of doping materials introduced in the powder mixture is almost completely contained in the finished, i.e., sintered alloy.

On the other hand, if the doping materials have melting points near the stated lower limit of 1500°°C., part of the doping materials introduced in the powder mixture escapes during sintering in the gaseous state because of the high vapor pressure and unavoidably carries along impurities of the alloy, which entails a positive cleaning or purifying effect.

Compression of the powder batches can be carried out on matrix or isostatic presses. Sintering of the compressed blanks is usually carried out at normal pressure and in an $H_2$-atmosphere. The sintering temperature is selected depending on the composition of the alloy; as a rule, however, such temperature has to be at least 200° C. below the melting point of the component with the lowest melting point. The achievable sinter densities will then come to more than 95% of the theoretical density. After sintering, mechanical reforming of the alloy of the invention by at least 85% is carried out, for example by rolling or drawing. Such mechanical reforming takes place in individual steps, whereby each reforming step advantageously results in reforming by about 10%. Heat treatments are carried out between the individual reforming steps, and it is important in this process that both the reforming temperature and the temperature of the heat treatment is below the recrystallization temperature in the given case.

Because of the high sinter densities achievable in the present case, mechanical reforming is connected with significantly fewer problems and less waste. For example, when reforming is carried out by rolling, fissuring or cracking of the sheet along the edges will be significantly reduced.

Finally, following reforming, the material is subjected to recrystallization annealing, which produces the tiered structural arrangement.

Table 1 shows on the molybdenum example a comparison of the creep resistance values of known alloys of high-melting metals according to the state of the art and the alloys of highmelting metals according to the invention.

Table 2 shows on the examples of molybdenum, tantalum, niobium and chromium the enhanced strength and hardness values of alloys of high-melting metals according to the invention, as compared to alloys of high-melting metals according to the state of the art, and non-alloyed high-melting metals.

With exception of the values of pure chromium and alloy 33, all values have been determined at room temperature. The values of pure chromium and alloy 33 have been determined at 300° C. because these materials are brittle at room temperature.

TABLE 1

| COMPOSITION | | | Creep Rate $\frac{m/m}{h}$ 1550° C. 28 N/mm² Load | 1750° C. 28 N/mm² Load |
|---|---|---|---|---|
| State of the art | | | | |
| Pure molybdenum | 100% Mo | | $5.5 \times 10^{-2}$ | $7.1 \times 10^{-1}$ |
| Alloy 1 | 150 ppm K<br>600 ppm Si<br>balance Mo | | $2.4 \times 10^{-4}$ | $9.7 \times 10^{-4}$ |
| Alloy 2 | 0.5 Ti<br>0.08 Zr, 0.05 C<br>balance Mo | | $1.3 \times 10^{-2}$ | $1.5 \times 10^{-1}$ |
| According to the invention | | | | |
| Alloy 3 | $La_2O_3$<br>Mo | 1 weight-%<br>99 weight-% | $1.3 \times 10^{-5}$ | $7.6 \times 10^{-5}$ |
| Alloy 4 | MgO<br>Mo | 1 weight-%<br>99 weight-% | — | $1.2 \times 10^{-4}$ |
| Alloy 5 | $Al_2O_3$<br>Mo | 1 weight-%<br>99 weight-% | — | $1.0 \times 10^{-4}$ |
| Alloy 6 | $La_2O_3$<br>W<br>Mo | 1 weight-%<br>5 weight-%<br>94 weight-% | $1.0 \times 10^{-5}$ | $5.6 \times 10^{-5}$ |

TABLE 2

| COMPOSITION | | Wire with 0.5 mm diam. and 1 mm sheet Tensile strength (N/mm²) | Elongation (%) | Hardness HV10 |
|---|---|---|---|---|
| State of the art | | | | |
| Pure Mo | 100% Mo | 1150 | 1 | 300 |
| Pure Ta | 100% Ta | 300 | 30 | 150 |
| Pure Nb | 100% Nb | 300 | 40 | 160 |
| Pure Cr | 100% Cr | 400 | 3 | 240 |
| Alloy 1 | 150 ppm K<br>600 ppm Si<br>balance Mo | 1600 | 2 | 300 |
| According to the invention: | | | | |
| Alloy 3 | $La_2O_3$ 1 weight-%<br>Mo 99 percent | 1520 | 2 | 330 |
| Alloy 4 | MgO 1 weight-%<br>Mo 99 percent | 1550 | 2 | 320 |
| Alloy 5 | $Al_2O_3$ 1 weight-%<br>Mo 99 percent | 1410 | 2 | 320 |
| Alloy 7 | $La_2O_3$ 0.01% by wt.<br>balance Mo | 1450 | 2 | 330 |
| Alloy 8 | MgO 0.01% by wt.<br>balance Mo | 1430 | 2 | 330 |
| Alloy 9 | $Al_2O_3$ 0.01% by wt.<br>balance Mo | 1380 | 2 | 320 |
| Alloy 10 | $Y_2O_3$<br>balance Mo | 1950 | 2 | 370 |
| Alloy 11 | $ZrO_2$ 1% by wt.<br>balance Mo | 1610 | 2 | 350 |
| Alloy 12 | CaO 1% by wt.<br>balance Mo | 1600 | 2 | 340 |
| Alloy 13 | $Y_2O_3$ 0.01% by wt.<br>balance Mo | 1400 | 1.5 | 350 |
| Alloy 14 | $ZrO_2$ 0.01% by wt.<br>balance Mo | 1410 | 2 | 320 |
| Alloy 15 | CaO 0.01% by wt.<br>balance Mo | 1500 | 2 | 330 |
| Alloys 16–21 | $Cr_2O_3$ or BaO or $CeO_2$ 1% by wt; or $HfO_2$ or $Ti_2O_3$ or $ThO_2$ 1% by wt. | 1400–1520 | 2 | 320–360 |
| Alloys 22–27 | $Cr_2O_3$ or BaO or $CeO_2$ or $HfO_2$ or $Ti_2O_3$ or $ThO_2$ 0.01% by wt., balance Mo | 1390–1480 | 2 | 320–350 |
| Alloys 29–30 | SrO 1.0 or 0.01% by wt; balance Mo | — | — | 310–317 |
| Alloy 31 | $La_2O_3$ 1% by wt.<br>balance Ta | 900 | 20 | 250 |
| Alloy 32 | $La_2O_3$ 1% by wt.<br>balance Nb | 600 | 20 | 220 |
| Alloy 33 | $La_2O_3$ 1% by wt.<br>balance Cr | 600 | 4 | 300 |

The preparation of the alloy of high-melting metals according to the invention is explained in greater detail in the following examples conforming with individual alloys, of which some are included in Tables 1 and 2.

EXAMPLE 1

Alloy 3 has been produced as follows:

99% by weight molybdenum metal powder with a grain size of 5 μm was mixed with 1% by weight $La(OH)_3$ powder with a grain size of 0.4 um and cold compressed isostatically at 3 MN to form square rods with a cross section of 2.5 sq. cm. Thereafter, the rods were sintered for 5 hours at 2000° C. under $H_2$ protective gas. The sinter density so obtained came to about 96% of the theoretical density. The sintered rods were hammered round to rods with a diameter of about 3 mm at reforming temperatures of about 1400° C., starting with graduations of about 10% degree of reforming in each case or step. Said rods were then drawn further at a temperature of about 800° C., starting in several steps to form wire with a diameter of 0.5 mm. The wire material so produced, after final recrystallization annealing at about 1900° C., had a tiered structural arrangement.

EXAMPLE 2

Alloy 4 was produced by the same method as specified in Example 1. Instead of $La(OH)_3$, 1 weight-% MgO with a grain size of 0.45 μm was mixed in, and wire with a diameter of 0.5 mm was produced.

EXAMPLE 3

Alloy 5 was produced by the same method as specified in Example 1. Instead of $La(OH)_3$, 1 weight-% $Al_2O_3$ with a grain size of 1.2 μm was mixed in, and wire material with a diameter of 0.5 mm was produced.

EXAMPLE 4

Another alloy according to the invention was produced as follows:

Molybdenum metal powder with a grain size of 5 μm was mixed with 2 weight-% $La(OH)_3$-powder with a grain size of 0.4 μm and the mixture was compressed on matrix presses at 3 MN to form sheets with the dimensions 17 cm ×40 cm ×5 cm. Subsequently, the sheets were rolled at reforming temperatures of about 1400° C. starting with graduations of about 10% degree of reformation, to obtain a sheet with a final sheet thickness of 1 mm. Following the final recrystallization annealing at about 1900° C., the sheet material had a tiered structural arrangement.

EXAMPLE 5

A tungsten alloy according to the invention was produced as follows:

99% by weight tungsten metal powder with a grain size of 4 μm was mixed with 1% by weight $La(OH)_3$-powder with a grain size of 0.4 μm and cold compressed isostatically at 3 MN to shape square rods with a cross section of 2.5 sq. centimeters. Thereafter, the rods were sintered for 12 hours at 22100° C. under $H_2$ protective gas. The sintered rods were hammered round at reforming temperatures of 1600° C., starting with graduations of about 10% degree of reforming in each step, to shape rods with a diameter of about 3 mm. Following recrystallization annealing at approximately 2300° C., said rods exhibited a tiered structural arrangement even at about 3 mm diameter.

Example 6

Another tungsten alloy comprising 1.0 weight-% $CeO_2$ was produced by the same method as specified in Example 5 except that the sintering step was carried out for 6 hours at a temperature of 2400° C. Further processing of the material to rods with a diameter of approximately 3 mm was carried out analogous to Example 5.

We claim:

1. Sintered, creep-resistant alloy with a tiered structural arrangement, comprising at least one high-melting metal selected from the group consisting of Mo, W, Nb, Ta, V, and Cr, and further comprising 0.005 to 10% by weight of at least one compound selected from the group consisting of the oxides, nitrides, carbides, borides, silicates and aluminates, including mixed phases thereof, said compound having a grain size of not greater than 1.5 um and a melting point in excess of 1500 ° C.

2. Sintered, creep-resistant alloy with a tiered structural arrangement as claimed in claim 1, wherein said alloy contains 1 to 5% by weight of the oxides of at least one of the elements selected from the group consisting of La, Ce, Y, Th, Mg, Ca, Sr, Hf, Zr, Er, Ba, Pr, Cr and mixtures thereof, said oxides having a grain size of not greater than 0.5 um.

3. Sintered, creep-resistant alloy with a tiered structural arrangement as claimed in claim 1, wherein said alloy contains 1 to 5% by weight of the borides or nitrides of hafnium or a mixture thereof having a grain size of not greater than 0.5 um.

4. Sintered, creep-resistant alloy with a tiered structural arrangement as claimed in claim 1, wherein said high-melting metal is molybdenum or a molybdenum alloy.

5. Sintered, creep-resistant alloy with a tiered structural arrangement as claimed in claim 1, wherein said high-melting metal is tungsten or a tungsten alloy.

6. Sintered, creep-resistant alloy with a tiered structural arrangement as claimed in claim 1, wherein said high-melting metal is chromium or a chromium alloy.

7. Method of producing the sintered, creep-resistant alloy with a tiered structural arrangement as claimed in claim 1, wherein said high-melting metal and said compound are mixed in the form of a highly fine, non-agglomerated and non-aggregated powder ; and the resulting powder mixture is compressed and sintered and the resulting sintered body is mechanically reformed with a degree of reformation of at least 85% and is subjected to heat treatments, said sintered body being finally subjected to recrystallization annealing.

* * * * *

UNITED STATES PATENT AND TRADEMARK OFFICE

CERTIFICATE OF CORRECTION

PATENT NO. : 4,950,327

DATED : August 21, 1990

INVENTOR(S) : RALF ECK

It is certified that error appears in the above-identified patent and that said Letters Patent is hereby corrected as shown below:

ON THE TITLE PAGE:

Insert --[30] Foreign Application Priority Data
January 28, 1987 [AT] Austria A158/87--;

[56] References Cited, under the heading Foreign Patent Documents, right hand column, line 4, "0119438 9/1984 United Kingdom" should read --0119438 9/1984 European Patent--;

[57] ABSTRACT, line 11, "porassium" should read --potassium--.

Column 1, Lines 8, "v" should read--V--;

Column 2, line 38 "high" should read --highly--;

Column 3, line 12, "15000" should read --1500--;

Column 3, lines 53-56, "La2O3, CeO2, Y2O3, ThO2, MgO, CaO; the mixed oxides Sr(Hf,Zr)O3, ZrO2, Er2O3, SrZrO3, Sr4Zr3O10, BaZrO3, as well as $La_{0.94}Sr_{0.16}CrO3$" should read --$La_2O_3$, $CeO_2$, $Y_2O_3$, $ThO_2$, MgO, CaO; the mixed oxides Sr(Hf,Zr)$O_3$, $ZrO_2$, $Er_2O_3$, $SrZrO_3$, $Sr_4Zr_3O_{10}$, $BaZrO_3$, as well as $La_{0.94}Sr_{0.16}CrO_3$--;

Column 3, line 57, "HfB2" should read --$HfB_2$--;

Column 4, line 39, "La(OH)3" should read --$La(OH)_3$--;

Column 4, lines 39-40, "La2(-CO3)3.8H2O" should read --$La_2(-CO_3)_{3.8}H_2O$--;

Column 4, line 40, "LaCl3.7H2O" should read --$LaCl_{3.7}H_2O$--;

UNITED STATES PATENT AND TRADEMARK OFFICE

CERTIFICATE OF CORRECTION

PATENT NO. : 4,950,327

DATED : August 21, 1990

INVENTOR(S) : RALF ECK

It is certified that error appears in the above-identified patent and that said Letters Patent is hereby corrected as shown below:

Column 4, line 41, "La2(MoO4)3" should read --$La_2(MoO_4)_3$--;

Column 4, line 51, "doing" should read -- doping --;

Column 4, line 58, "°°C." should read --°C.,--;

Column 7, line 45, "22100°C." should read --2100°C.--.

Signed and Sealed this

Thirteenth Day of April, 1993

*Attest:*

STEPHEN G. KUNIN

*Attesting Officer*

*Acting Commissioner of Patents and Trademarks*